United States Patent [19]

Russell et al.

[11] Patent Number: 4,916,772

[45] Date of Patent: Apr. 17, 1990

[54] PORTABLE DRAIN CLEANING APPARATUS

[75] Inventors: V. L. Russell, Bethany; Kerry Cannon, Moore, both of Okla.

[73] Assignee: National Manufacturing & Supply Corporation, Oklahoma City, Okla.

[21] Appl. No.: 256,744

[22] Filed: Oct. 12, 1988

Related U.S. Application Data

[63] Continuation-in-part of Ser. No. 166,916, Mar. 11, 1988.

[51] Int. Cl.[4] ..... B08B 9/02

[52] U.S. Cl. ..... 15/104.33

[58] Field of Search ..... 15/104.33

[56] References Cited

U.S. PATENT DOCUMENTS

| | | | |
|---|---|---|---|
| 3,025,547 | 3/1962 | Ciaccio | 15/104.3 |
| 3,162,878 | 12/1964 | Agostino | 15/104.33 |
| 3,246,354 | 4/1966 | Cooney et al. | 15/104.33 |
| 3,298,051 | 1/1967 | Ratlift | 15/104.33 |
| 3,370,599 | 2/1968 | Ciaccio | 134/167 |
| 3,608,122 | 9/1971 | Ratliff | 15/104.33 |
| 3,959,840 | 6/1976 | Sato | 15/104.3 |
| 4,287,630 | 9/1981 | Perez | 15/104.33 |
| 4,312,679 | 1/1982 | Klein, Sr. | 134/8 |
| 4,368,757 | 1/1983 | Finger | 137/565 |
| 4,420,852 | 12/1983 | Bowlsby | 15/104 |
| 4,464,806 | 8/1984 | Prange | 15/104.33 |
| 4,716,613 | 1/1988 | Irwin | 15/104.33 |
| 4,773,113 | 9/1988 | Russell | 15/104.33 |

*Primary Examiner*—Edward L. Roberts
*Attorney, Agent, or Firm*—Bill D. McCarthy

[57] ABSTRACT

A portable drain cleaning apparatus comprising a payout drum supporting a coil spring snake wound therein and supported for rotation on a support frame, the payout drum being detachable and replaceable with similar drums supporting different sized and configured snakes.

5 Claims, 2 Drawing Sheets

PORTABLE DRAIN CLEANING APPARATUS

CROSS REFERENCE TO RELATED APPLICATION

This application is a continuation-in-part of Design patent application Ser. No. 166,916 entitled PORTABLE ROTATING CLEANER filed Mar. 11, 1988, and now pending.

BACKGROUND OF THE INVENTION

1. Field of the Invention

The present invention relates generally to improvements in drain cleaning apparatus, and more particularly, but not by way of limitation, to a portable drain cleaning apparatus having multiple combination usages for servicing a broad range of drain sizes and piping component combinations, including traps and short bends.

2. Discussion of Prior Art

Drain cleaning apparatuses of various types and arrangements have been known for many years. Bowlsby, U.S. Pat. No. 4,420,852, teaches the use of a rotating drum having a length of coiled spring snake with an internally extending flexible tube for carrying a flow of water to the free end of the snake. Tap water is passed at house pressure to the hub of the drum to which the near end of the snake is attached. However, this does not provide any cleaning efficacy, as the low pressures encountered in such service are simply ineffective to provide any practical benefit.

Sato, U.S. Pat. No. 3,959,840, is similar, but includes a pump which communicates with a water tank for delivering a high pressure water jet to the free end of the flexible tube.

Ciaccio, U.S. Pat. No. 3,045,547, is an earlier teaching of a wheel supported portable apparatus which deals with the matter of simultaneously feeding and rotatably driving a coiled rod with a cutting tool mounted thereon for cleaning municipal sewers, and with the imparting of variable rotating and payout speeds by means of power provided by a gasoline engine. Ciaccio, U.S. Pat. No. 3,370,599, also dealing with large municipal sewers, teaches a similar rotatable drum and power apparatus but adds a rotary hydraulic cleaning tool incorporating a forwardly-directed cleaning jet and rearwardly-directed propulsion jets to assist in propelling the tool along the sewer pipe.

Klein, Sr., U.S. Pat. No. 4,312,679, teaches a method for cleaning clogged pipes in which a snake hose having a free nozzle with radially directed jets is forced through a clogged pipe and withdrawn in flushing activation. The claimed purpose is to avoid dirty water backup in the pipe's internally positioned inlets.

Finger, U.S. Pat. No. 4,368,757, teaches a pressure cleaning apparatus having a pair of fluid containers used to blend detergent and water to the suction inlet of a pump. However, this patent, being of interest in the general area of pressurized cleaning devices, does not deal with the cleaning of sewer lines and the like.

These and all other known prior art teachings have faced specific problems associated with the cleaning of municipal, industrial and domestic lines. As discerned from the above mentioned patents, as well as from the experience in the field of drainage cleaning, a fairly wide array of cleaning devices is available to the craftsman faced with a particular stoppage difficulty. However, when called to a location, one is usually informed only vaguely as to what is to be expected in terms of line sizes, trap types and locations, and other such information necessary for the cleaning task at hand. Thus, the normal service operator may be ill equipped to adapt in terms of equipment to the problem encountered. In short, a drain cleaning apparatus which offers a wide range of systems that can be used in various combinations to accommodate and bring relief to a customer's plaintive but ill described request for assistance has attractive and useful possibilities in this field.

One item of equipment which would be most helpful is a lightweight, portable drain cleaning apparatus that can easily be taken to practically every location, including roof decks and the like.

SUMMARY OF THE INVENTION

The present invention comprises a drain cleaning apparatus featuring multiple use capability. A rotatable payout drum is supported by a small, easily carried frame which also supports a power source for selectively rotating the payout drum in either rotational direction. A coil spring snake is wound in the payout drum which has a central hollow hub through which the snake is extendable and rotatable concentrically with the drum.

The payout drum is supported for quick detachment and removal, for the purpose of mounting a substitute payout drum containing a different sized snake.

In one embodiment of the present invention, the free end of the snake is provided with a conventional spring coil which has proven to be quite successful in clearing most household stoppages. Yet another embodiment features a pair of cutter blades for removing more firmly established blockages such as are frequently caused by tree roots.

It is an object of the present invention to provide an improved drain cleaning apparatus having multiple use capability for a wide range of drain pipes and sizes.

Another object of the present invention, while achieving the above stated object, is to provide an improved drain cleaning apparatus which is sufficiently light in weight that one man can carry it easily, and which is in a small, compact package to permit it to be used in cramped, awkward spaces.

A further object of the present invention, while achieving the above stated objects, is to provide an improved drain cleaning apparatus which offers wide flexibility of servicing capability while enjoying economy of manufacturing, operating and maintenance costs.

Other objects, advantages and features of the present invention will be apparent from the following description when read in conjunction with the accompanying drawings and appended claims.

BRIEF DESCRIPTION OF THE DRAWINGS

In the accompanying drawings, which form part of the instant specification and which are to be read in conjunction therewith, and in which like reference numerals are used to indicate like parts of the various views.

DESCRIPTION

Figure 1:
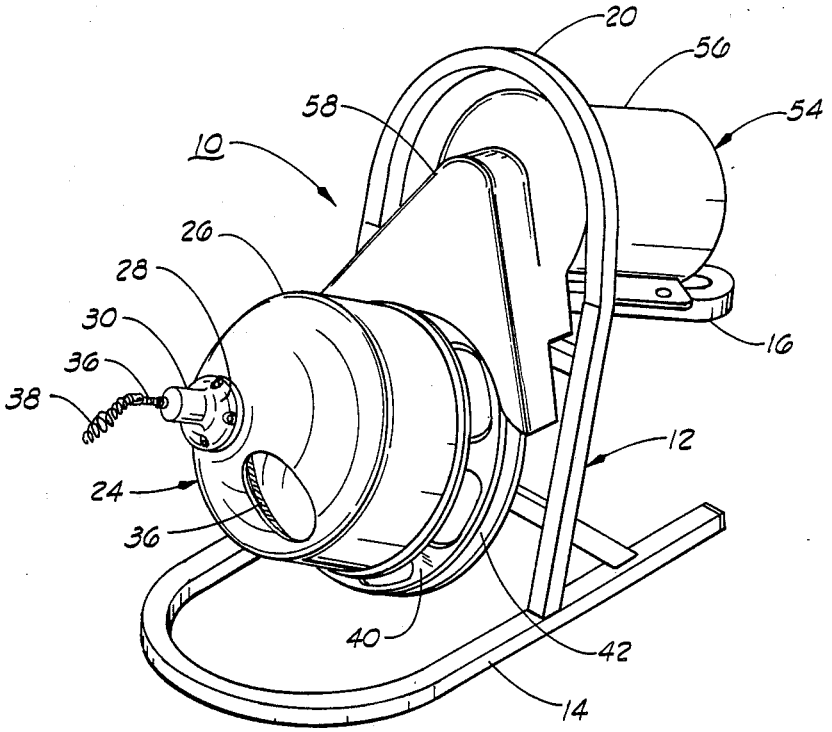
FIG. 1 is a perspective view of a multiple use drain cleaning apparatus made in accordance with the present invention.
Figure 2:
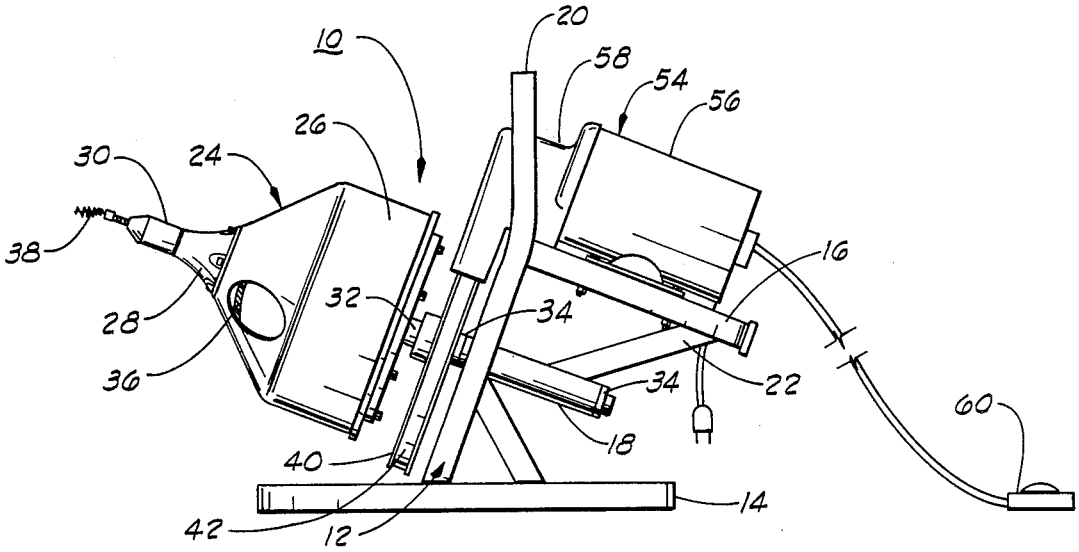
FIG. 2 is an elevational view of one side of the drain cleaning apparatus of FIG. 1.

Referring to the drawings in general, and more particularly to FIGS. 1 and 2, shown therein is a drain cleaning apparatus 10 constructed in accordance with the present invention. The drain cleaning apparatus 10 comprises a main frame assembly 12 constructed of tubular material having a generally horizontal base 14, a motor support member 16, a drive shaft support member 18, and a carrying handle 20. The motor support member 14 and the drive shaft support member 18 (shown in FIG. 2) are assembled in such a manner as to be disposed in fixed spatial relation, and somewhat angularly, to each other. Cross braces 22 are provided in the main frame assembly 12 for strength and rigidity thereof.

In FIG. 2, a drum assembly 24 is shown mounted on main frame assembly 12, the drum assembly 24 comprising a generally cylindrically shaped hollow payout drum 26, a chuck holder adapter 28, and a contractable jaw chuck 30.

As will be appreciated, drum assemblies for coiled cleaning cable are known in the art, and the drum assembly 24 need not be described in detail, except to note that the drum assembly 24 is supported on a rotatable drive shaft 32. The drive shaft 32 is supported by appropriately disposed bearings 34 supported by the drive shaft support member 18. A coil spring cleaning snake 36 is wound up within the drum 26 in its storage mode and extends through the centrally located chuck holder adapter 28 and the jaw chuck 30 for concentric rotation therewith. A snake cleaning head 38 is supported by the extending end of the coil spring cleaning snake 36. A drum drive wheel 40 is mounted on the drive shaft 32 and a drive belt 42 extends thereover.

Figure 3:
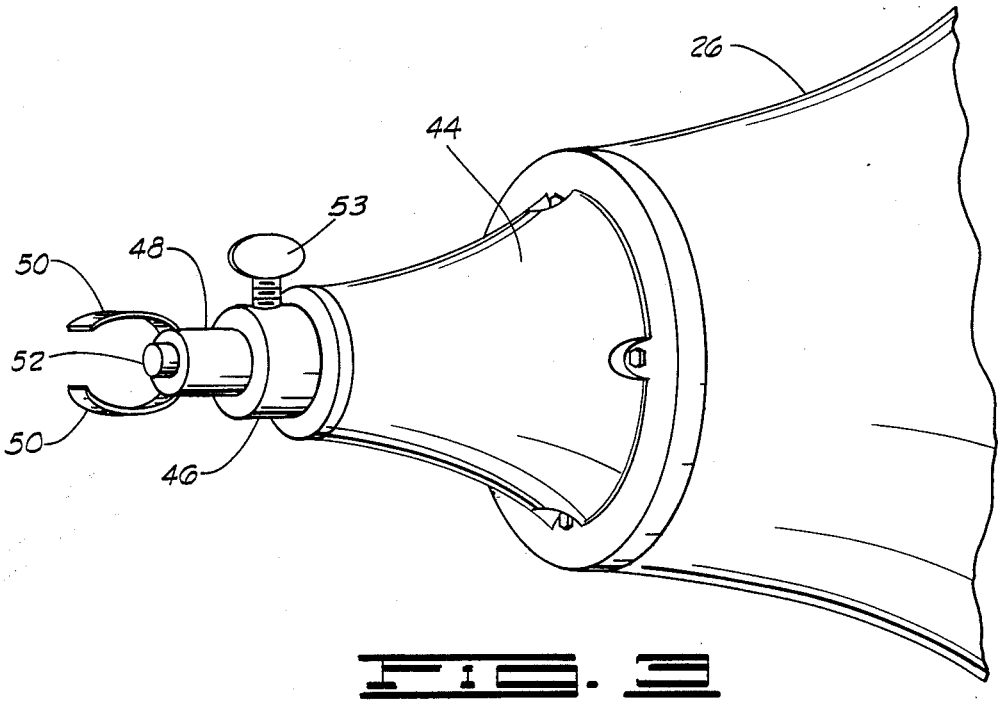
FIG. 3 is an enlarged perspective view of an alternate chuck holder adapter mounted on a payout drum of the drain cleaning apparatus of FIG. 1 and which shows a pair of cutter blades affixed to the end of the coil spring snake.

The payout drum 26 can be fitted with a variety of adapters and cleaning heads to accommodate different stoppage problems encountered on the customer's premises. FIG. 3 shows one such alternate configuration, with an alternate chuck holder adapter 44 bolted onto the payout drum 26. This alternate chuck holder adapter 44 accommodates a snake guide arm 46 through which extends the coil spring cleaning snake 36, and a snake cleaning head 48 is supported on the end thereof. A pair of cutter blades 50 are affixed to the snake cleaning head 48 by a hold down screw 52. A cable set screw 53 can be loosened or tightened to permit passage of the coil spring cleaning snake 36 or to grippingly secure same to the snake guide arm 46.

Referring again to FIG. 2, mounted on the appropriately located motor support member 16 is a power assembly 54. The power assembly 54 comprises an electric motor 56 which is preferably a variable speed unit, and a power sheave (not shown) for receiving the drive belt 42 for imparting rotational power to the drive wheel 40. A protective safety guard 58 is preferably provided over the power sheave and the upper portion of the drive belt 42. Conventional electrical switching and controls are provided, and may include a foot switch 60. A ground fault interrupter (not shown) can be provided to lessen the danger of electrical shock in the event of an electrical short circuit condition.

Figure 4:
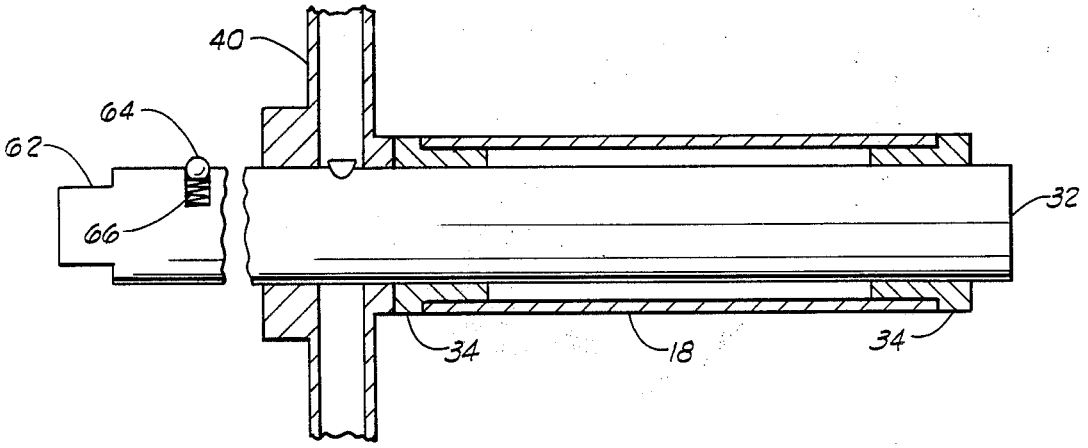
FIG. 4, is a longitudinal cross-sectional view through the center of the drive shaft of the drain cleaning apparatus of FIG. 1.

Referring now to FIG. 4, this cross-sectional view of the drive shaft 32 illustrates a novel fastening principle in drain cleaning machines. An outboard end 62 of the drive shaft 32 is machined in such a manner as to form a key which fits into a matching slot (not shown) on the inboard end of drum 26 (shown in FIGS. 1 and 2). Drive shaft 32 is also equipped with a locking ball 64 similar to that which is used in a socket wrench. When payout drum 26 is pushed onto drive shaft 32, hand pressure is sufficient to depress ball 64, thus permitting the machined drive shaft end 62 to be firmly seated into the matching slot (not shown) in the inboard end of drum 26. When the payout drum 26 is completely seated, a spring 66 thrusts the locking ball 64 into an appropriately disposed and sized indentation (not shown) formed in the interior diameter of the center hole on the inboard side (not shown) of payout drum 26, thus locking the payout drum 26 onto drive shaft 32.

In operation, the drain cleaning apparatus 10 is carried via its handle 20 to a position of conduit entry, such as in a basement or in a roof, and the base 14 of the drain cleaning apparatus 10 is set onto a convenient hard surface (such as a floor or a roof). Assuming that the drain cleaning apparatus 10 is equipped in the embodiment shown in FIGS. 1 and 2, the jaw chuck 30 is loosened and the coil spring cleaning snake 36 is pulled out of the payout drum 26 sufficiently to extend the snake cleaning head 38 into the conduit to be cleaned. With the snake cleaning head 38 in the conduit, the coil spring cleaning snake 36 is extended until the restriction in the conduit is reached by the snake cleaning head 38. At this point, the jaw chuck 30 is tightened and the power assembly 54 is energized to rotate the drum drive wheel 40 via the drive belt 42. This rotates the drive shaft 32 on which the payout drum 26 is supported. As the payout drum 26 is rotated, the coil spring cleaning snake 36 is caused to rotate concentrically about its longitudinal axis even if bent or curved within the conduit being cleaned.

Since the drain cleaning apparatus 10 is lightweight and portable, the operator can grippingly support the handle 20 while gently advancing the rotating coil spring cleaning snake 36 to push the snake cleaning head 38 against the blockage. As necessary, the drain cleaning apparatus 10 can be set down, the jaw chuck 30 again loosened and the coil spring cleaning snake 36 extended further, with or without stopping or slowing down the rotation of the drive shaft 32 by the electric motor 56. Once the extending length of the coil spring cleaning snake 36 has been adjusted as necessary, the drain cleaning apparatus 10 can again be lifted and the operation continued. This procedure can be repeated until the conduit blockage has been cleared.

To take up the coil spring cleaning snake 36, with the electric motor 56 deenergized, the jaw chuck 30 is loosened and the coil spring cleaning snake 36 is hand pulled from the conduit so as to be pushed back into the payout drum 26. Once this is accomplished, the drain cleaning apparatus 10 can be carried to another location of use.

The structure of the snake cleaning head 38 permits for quick removal of the drum assembly 24 and for quick remounting of a replacement drum assembly 24 thereon. This feature is very beneficial as several drum assemblies of varying sizes and configuration can be inventoried as required for the range of jobs encountered in any given service area.

From the above, it is clear that the present invention is well adapted to carry out the objects and to attain the ends and advantages mentioned herein as well as those inherent in the invention. While preferred embodiments of the invention have been described for the purposes of this disclosure, numerous changes can be made which will readily suggest themselves to those skilled in the art and which are encompassed within the spirit and scope of the invention disclosed herein and as defined in the appended claims.

What is claimed is:

1. A portable drain cleaning apparatus comprising:

a frame assembly having a plurality of frame members; a drive shaft rotatably supported by the frame assembly;

a drum assembly removably supported by the drive shaft comprising a payout drum, a chuck holder adapter,-and a contractable jaw chuck;

a coil spring cleaning snake supported by the payout drum and extendable through and grippingly connected to the contractable jaw chuck; and power means supported by the frame assembly for selectively rotating the drive shaft so that the payout drum is rotated thereby.

2. The portable drain cleaning apparatus of claim 1 wherein the power means comprises an electric motor supported by the main frame assembly.

3. The portable drain cleaning apparatus of claim 2 wherein the payout drum is removably supported by the drive shaft and replaceable with various sizes of similarly constructed payout drums.

4. The portable drain cleaning apparatus of claim 3 wherein the payout drum has a central hollow hub and the coil spring cleaning snake has a free end which is extendable through the central hollow hub- and which is rotatable concentrically with the payout drum to impart rotation to the free end, and wherein the power means is further characterized as selectively rotating the drive shaft.

5. The portable drain cleaning apparatus of claim 4 wherein the drive shaft is equipped with a spring actuated locking ball connector for quick mounting and removal of the drum assembly.

* * * * *